US009604751B2

(12) United States Patent
Baryshyan

(10) Patent No.: US 9,604,751 B2
(45) Date of Patent: Mar. 28, 2017

(54) DIE CUT, SCORED AND COATED BOARD DIVIDER

(71) Applicant: FC Meyer Packaging LLC, Norwalk, CT (US)

(72) Inventor: Matthew Arthur Baryshyan, Stormville, NY (US)

(73) Assignee: FC Meyer Packagaing LLC, Norwalk, CT (US)

( * ) Notice: Subject to any disclaimer, the term of this patent is extended or adjusted under 35 U.S.C. 154(b) by 0 days.

(21) Appl. No.: 14/733,474

(22) Filed: Jun. 8, 2015

(65) Prior Publication Data

US 2016/0355295 A1 Dec. 8, 2016

(51) Int. Cl.

| | |
|---|---|
| ***B65D 5/49*** | (2006.01) |
| ***B65D 85/30*** | (2006.01) |
| ***B65D 5/50*** | (2006.01) |
| ***B65D 5/56*** | (2006.01) |

(52) U.S. Cl.

CPC ..... *B65D 5/5076* (2013.01); *B65D 5/563* (2013.01); *B65D 85/30* (2013.01)

(58) Field of Classification Search

CPC ..... B65D 5/5076; B65D 5/563; B65D 85/30; B65D 5/5078; B65D 5/5083; B65D 5/508; B65D 5/48042; Y10S 229/902; Y10S 229/906

USPC ..... 229/120.23, 120.35; 426/119, 120

See application file for complete search history.

(56) References Cited

U.S. PATENT DOCUMENTS

| | | | | |
|---|---|---|---|---|
| 3,298,512 | A * | 1/1967 | Crane | B65D 5/5083 206/423 |
| 3,849,932 | A * | 11/1974 | Adams | B65D 25/04 206/423 |
| 5,052,559 | A * | 10/1991 | Bressi, Jr. | B65D 81/261 206/525 |
| 8,597,733 | B2 * | 12/2013 | Vonfelden | C09D 167/02 427/374.1 |
| 2006/0283925 | A1 * | 12/2006 | Specker | B65D 5/2076 229/120.24 |

FOREIGN PATENT DOCUMENTS

| | | | | |
|---|---|---|---|---|
| DE | 20002419 | U1 * | 5/2000 | B65D 5/48042 |
| EP | 543660 | A2 * | 5/1993 | B65D 5/48042 |

OTHER PUBLICATIONS

Lori Williams, Scor-pal, "Six Pack Box by Lori Williams", www.scor-pal.com, http://scor-pal.blogspot.com/2012/12/six-pack-box-by-lori-williams.html, Dec. 6, 2012.

* cited by examiner

*Primary Examiner* — Gary Elkins

(74) *Attorney, Agent, or Firm* — Robert J. Hess; Hess Patent Law Firm

(57) ABSTRACT

A divider that has a die-cut board that is grease resistant coated on both sides and is scored to define a plurality of alternative valley and peak folds. There is at least one perforated line that passes through all of the valley and peak folds. The divider may taper at its sides from the peak folds to neighboring ones of the valley folds. Two perforated lines may be provided to sever the tapers from the sides to leave the sides substantially reside in parallel planes with respect to each other.

16 Claims, 5 Drawing Sheets

DIE CUT, SCORED AND COATED BOARD DIVIDER

BACKGROUND OF THE INVENTION

Tacos for take out typically are crisp tacos served wrapped and in a bag for the lower priced fast food. More upscale tacos are soft flour tacos filled and then arranged in a single pattern, placed in a take out box.

The heat of the taco filling, combined with the glutens of the flour tortilla, cause the shingled tacos to fuse together.

SUMMARY OF THE INVENTION

A die cut and scored board is coated on both sides to serve as a divider to retain tacos in a manner that keeps them separate from each other. The die cut, scored and coated board divider can be folded on the scores and placed into either a nested style food container that has a taper or in a rectangular style straight sided box. Such a divider keeps tacos separated so they do not make contact with each other and therefore retain all their textural elements. Additionally, the tacos are presented in an upright position for maximum appetite appeal.

While the divider may retain tacos in a manner that separates them from each other, the divider may be also used to retain other kinds of food products in a manner that separates them from each other. For example, such food products preferably include an edible "pocket" in the form of a flour shell, roll, sandwich wrap, pita bread, croissant, pocket bread, bagel, folded flatbread, etc.

The divider is double-sided coated so that it does not stain upon contact with the grease of the taco filling. The presence of grease stains, whether from the taco filling or from personnel handling, is unsightly and thus it is beneficial for customer appeal that the coating be resistant to grease stains. This coating is a conventional coating that is 100% water-based, recyclable and compostable within 90 days in a properly managed landfill.

When folded, the divider forms a series of alternating peak and valley folds that separate a succession of panels of the die-cut board. Preferably, the die cut is such that the sides of the divider with the fold lines taper from the peak folds to two neighboring one(s) the valley folds. That way, the divider can be sized to appear to fit in a snug manner within a box whose sidewalls likewise taper from an open top to the bottom.

Preferably, there is at least one line of perforations may be provided that passed through all the peak and valley folds. For instance, there could be two sidelines of perforations whose severing would allow the tapered strips to be discarded and there could be one additional line of perforations centrally located so that severing the additional line of perforations separates the die-cut board into two divider halves. Note that severing the two sideline perforations effectively removes the taper from the peaks to the valleys. As a result, the sides of the divider lie substantially in parallel vertical planes with no taper.

As can be appreciated, by coating the divider on both the two V-shaped slot face and the three V-shaped slot face, the divider can be used in a two-taco pack position as well as a three-tack pack position and still be useful in grease resistance. That is, by resisting grease stains from appearing in the divider whether from contents of the tacos or from handling by personnel. Further, there would no longer be a need to wrap the tacos individually, thereby yielding material cost savings with respect to the cost for wrappers and yielding labor cost savings with respect to labor involved to perform taco wrapping.

One aspect of the invention resides in a divider that has a die-cut board configured to move under manual force between a fully flattened condition and a completely folded condition. The die-cut board is movable from the fully folded condition to a released condition that is intermediate the fully flattened condition and fully folded condition upon release of the manual force.

The die-cut board has a plurality of scored lines spaced apart from each other and bending at each of the scored lines to form a series of alternating peak and valley folds between panels of the die-cut board. Each of the scored lines have a depth sufficient for spring-back memory so that the release of the die-cut board from the completely folded condition results in the die-cut board unfolding to spread out into the released condition. At least one line of perforations passes through the series of alternating peak and valley folds. A plurality of divider chambers is formed with each defined by a respective pair of the panels that has a respective one of the valley folds between the pair of the panels. A water-based, grease-resistant coating coats faces of the panels.

Another aspect resides in the at least one line of perforations being centrally located and severing the perforations to provide two smaller divider halves. The divider halves therefore have a side edge with portions of the severed perforations that complement each other.

Still another aspect resides in placing the die-cut board or one of the divider halves into a box such that their ends contact and press against opposite walls of the box. Also, the two divider halves could be placed into two boxes respectively with their ends in contact and pressing against opposite walls of respective ones of the two boxes.

BRIEF DESCRIPTION OF THE DRAWING

For a better understanding of the present invention, reference is made to the following description and accompanying drawings, while the scope of the invention is set forth in the appended claims.

DETAILED DESCRIPTION OF THE INVENTION

Figure 1:
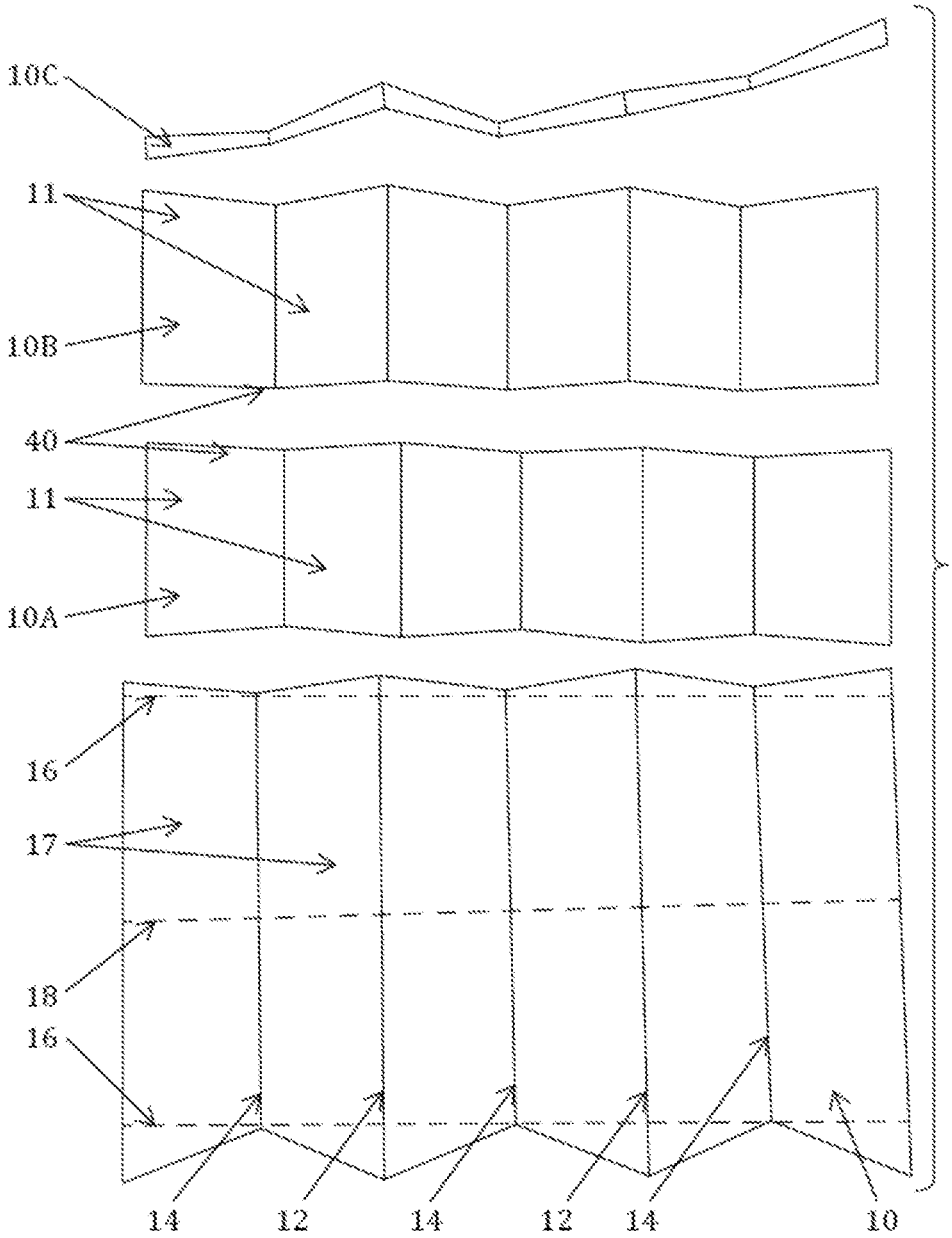
FIG. 1 is a progressive view of a die cut, scored, coated board divider in accordance with the invention, showing the divider before and after perforations are severed.

Turning to the drawing, FIG. 1 shows a progressive view of a divider before and after perforation severing. The divider is made of a die-cut board 10 (such as a paper board) that is die cut, scored and double-sided coated. The coating is 100% water-based, recyclable and compostable within 90 days in a properly managed landfill. A conventional perfecting press may be used to shape the divider and provide the score lines and coat both sides.

When the die-cut board 10 is folded at the scores to form the divider chambers 15, there arises an alternating set of peak folds 12 and valley folds 14 at the scores.

Each of the divider chambers 15 is bounded by a pair of panels 17 of the die-cut board 10 with one of the valley folds 14 between the pair of panels 17.

Figure 5:
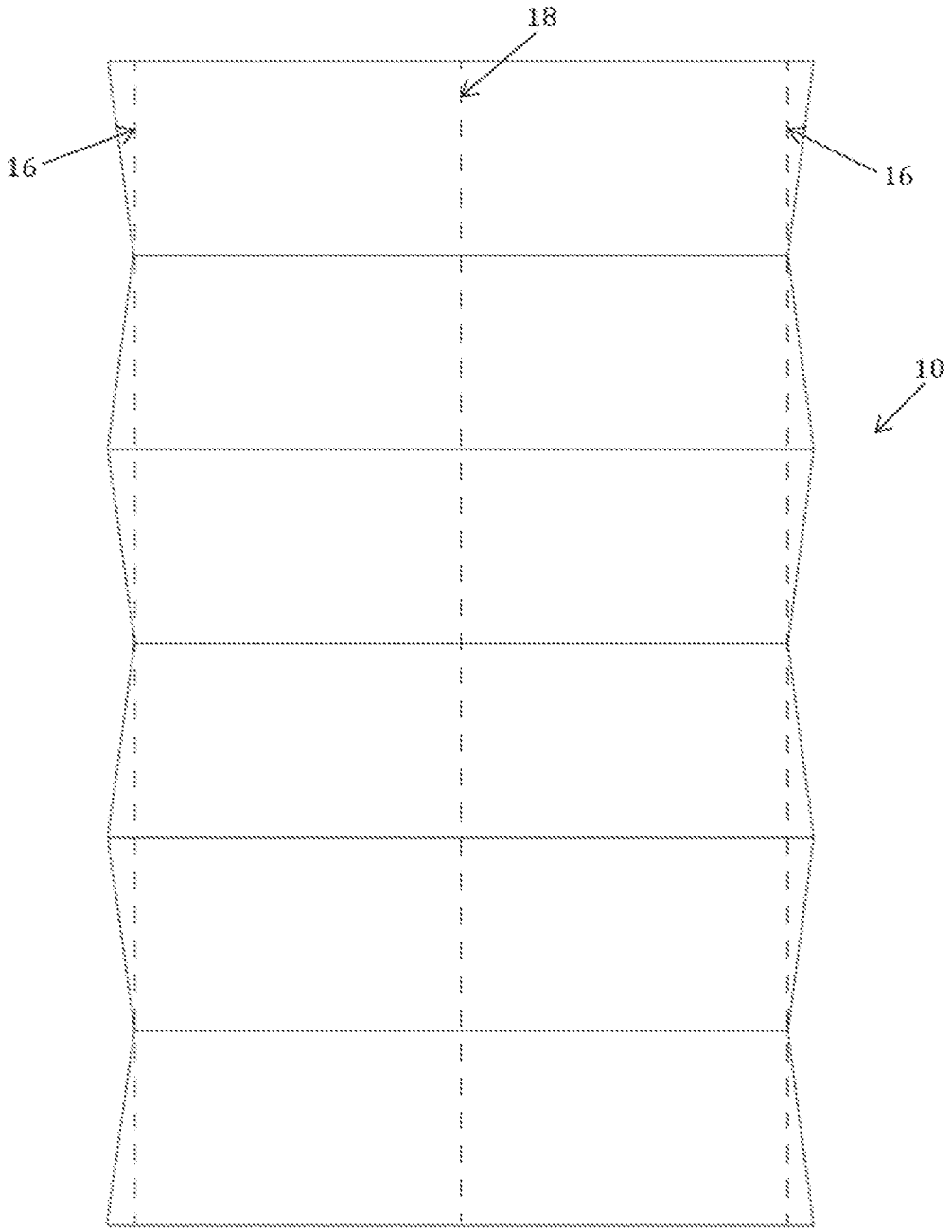
FIG. 5 is a top view of the die cut, scored, coated board divider of FIG. 1 before any perforations are severed.

There is at least one line of perforations that passes through the entire set of peak and valley folds. Preferably, there may be two lines of sideline perforations 16 and centerline perforations 18 (see FIGS. 1 and 5). The centerline perforations 18 would be spatially separated from and located centrally between the two sideline perforations, all of which lines of perforations 16, 18 being substantially parallel to each other.

After severing the sideline perforations 16 and the centerline perforations 18, there would be left two divider halves 10A, 10B and two tapered strips 10C formed by severing the sideline perforations (only one shown in FIG. 1, but the other is symmetric or a mirror image). The two tapered edges 10C are to be discarded.

The two divider halves 10A, 10B define the divider chambers 15, which are bounded by a pair of panels 11 of the associated divider half 10A, 10B that has a respective one of the valley folds 14 between the pair of panels 11.

As a consequence of providing for such perforations, there arises flexibility as to the divider size. The divider size does not have to take up the full dimension of the box for take out to fulfill the function of retaining tacos separate from each other. If a side order from a menu is offered for take out, for instance, in addition to the tacos, the die-cut board 10 can be separated into halves by severing at the centerline perforation 18 that is provided for that purpose. As a result, two shorter divider halves 10A, 10B are formed that enable the tacos to be served with a side of rice or beans or a salad in the same box for take out. The divider halves 10A, 10B each have severed portions 40 of perforations along one of their edges where they were separated and thus corresponding ones of the severed portions 40 of perforations from each of the divider halves 10A, 10B complement each other.

Figure 2:
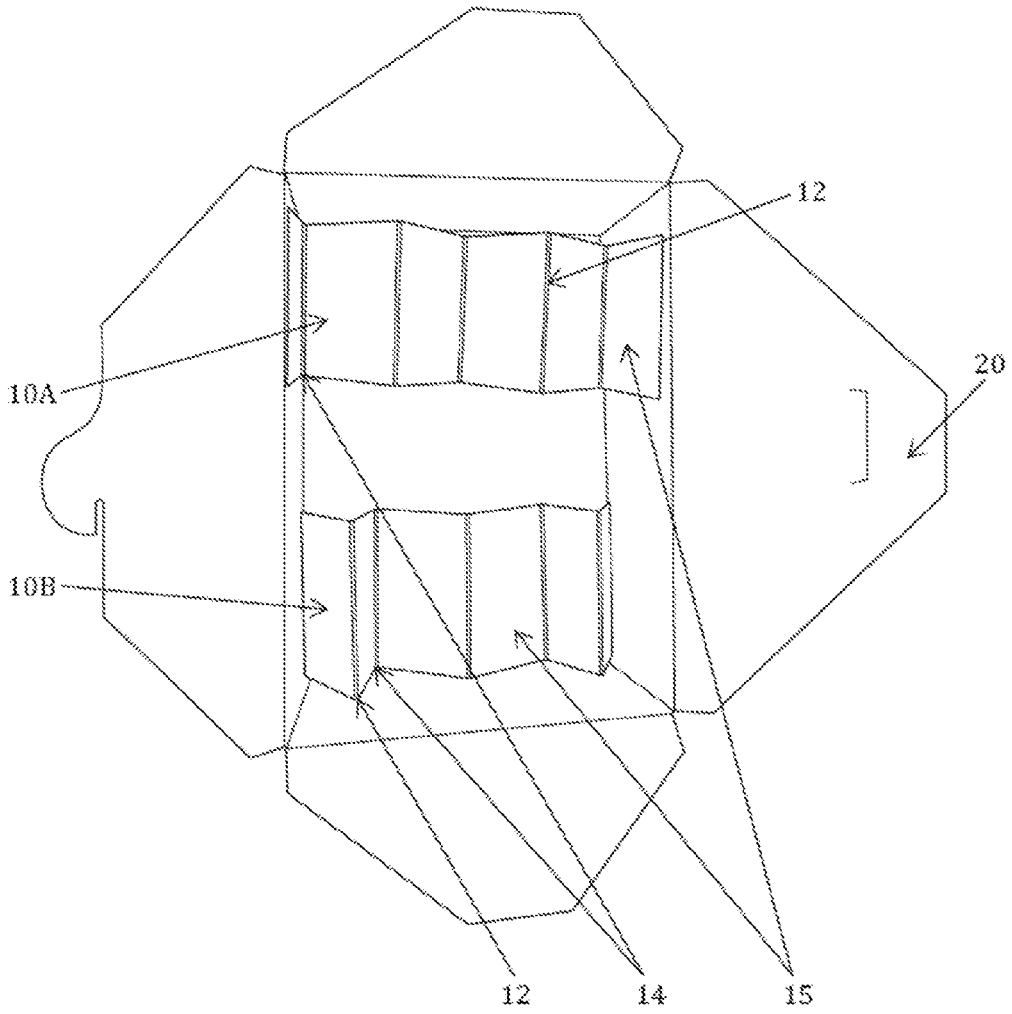
FIG. 2 is a top view of a non-tapered box containing the dividers of FIG. 1 (after perforation severing).
Figure 3:
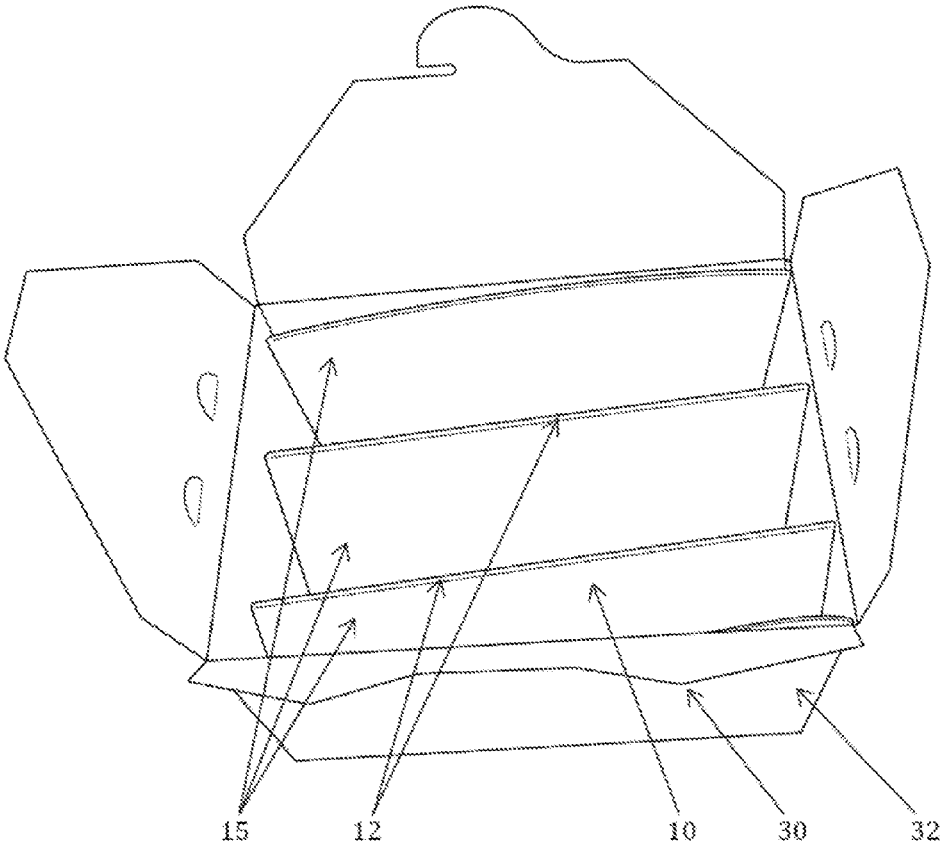
FIG. 3 is an isometric view of a tapered box containing a divider of FIG. 1 (prior to perforation severing).

Turning to FIGS. 2 and 3, the die-cut board 10 (or each of die-cut halves 10A. 10B) has scores (peak folds 12, valley folds 14) that separate the divider chambers 15 from each other and are only at most 40% score depth of the total thickness of the die-cut board 10 so that the folded (accordion style) die-cut board 10 (or each die-cut half 10A, 10B), when folded, has a maximum amount of dead fold resistance, memory (or spring back).

When the die-cut board 10 is placed in a box (such as the tapered box 30 of FIG. 3) for take-out and released from its fully folded condition under manual force, the release causes the die-cut board 10 to spring back (tending to unfold) so as to have the die-cut board 10 fully cover the chamber floor of the box with end edges of the die-cut board 10 coming into contact with and pressing the opposite walls of the box.

Turning to FIG. 2, the two divider halves 10A, 10B are shown within the confines of a non-tapered box 20 that is of a rectangular straight wall style. The two divider halves 10A, 10B are shown flipped over relative to each other. That way, divider half 10A has three divider chambers topside and divider 10B has two divider chambers topside. That is, there is a different number of divider chambers facing topside as between the two halves 10A, 10B. The two divider halves 10A, 10B rest upon a topside of the bottom of the non-tapered box 20.

In practice, only one of the two divider halves 10A, 10B would be placed in any one box to accommodate one order of tacos, but the other would be placed in another box to accommodate another order of tacos. The remaining space in the box (with just one of the two divider halves 10A, 10B in the box) could accommodate other food items from the menu, such as rice or beans or salad.

There may be no need, however, to sever the sideline perforations 16 once the centerline perforations 18 are severed, because either one of the two divider halves 10A, 10B, even with the taper strips attached, will fit within the non-tapered box 20.

That is, the underside of either of the two divider halves may rest upon the top of the bottom of the box.

Turning to FIG. 3, the die-cut board 10 is positioned within a tapered box 30 whose sidewall 32 tapers from top to bottom. The sides of the die-cut board 10 are shaped to taper in a complementary manner to the taper of the box sidewall 32. The sides of the die-cut board 10 taper from the peak folds to neighboring ones of the valley folds and thus from top to bottom. Inserting the die-cut board 10 into the tapered box 30 results in the tapered sides of the die-cut board 10 being accommodated upon or against the tapered sidewall 32 of the tapered box 30 so that the bottom side of the divider clears the tapered sidewall 32 to rest upon the topside of the bottom of the tapered box 30.

However, flipping the die-cut board 10 over would mean it would not fit into the tapered box 30 in that orientation. This is because the underside of the divider 10 after flipping is too large to clear the inward taper of the tapered box 30 and thus could not reach the top of the bottom of the tapered box 30 to rest upon it.

For that reason, severing the sideline perforations 16 and discarding them yields the die-cut board 10 but without the side taper and thus is dimensioned to clear the sidewalls 32 of the tapered box 30 after being flipped over and thus be able to rest upon the topside of the bottom of the tapered box 30. Such perforation severing offers the flexibility to flip the (non-tapering) die-cut board 10 over to give a user the choice as to the number of divider chambers or divider chambers 15, which are V-shaped, that will face topside and thus a corresponding number of tacos that can be placed into the V-shaped chambers for retention. Each divider chamber 15 has a pair of panels 17 that incline from a single valley fold between them to form the V-shape.

If the divider has, for instance, three divider chambers 15 formed on one face to accommodate retaining three tacos and has two divider chambers 15 formed on the opposite face that can accommodate two tacos (albeit slightly larger tacos than is the case for the one face), then severing the centerline perforations 18 to remove the taper enables the divider to be accommodated in the box to rest on the topside of the bottom of the box with either the two divider chamber 15 face or the three divider chamber 15 face being on top.

As an alternative or in addition, the die-cut board 10 could also be severed at the centerline perforations 18. Either of the resultant two divider halves 10A, 10B would fit within the tapered box 30, with or without the tapered side attached.

As a further alternative, if the tapered box 30 could be replaced by a non-tapered box 20 of FIG. 1 of large enough dimension, then the die-cut board 10 would fit the box and may rest on the topside of the bottom of the non-tapered box 20 in either of its orientations, i.e., with the three-divider chamber 15 face topside or with the two-divider chamber 15 face topside.

Figure 4:
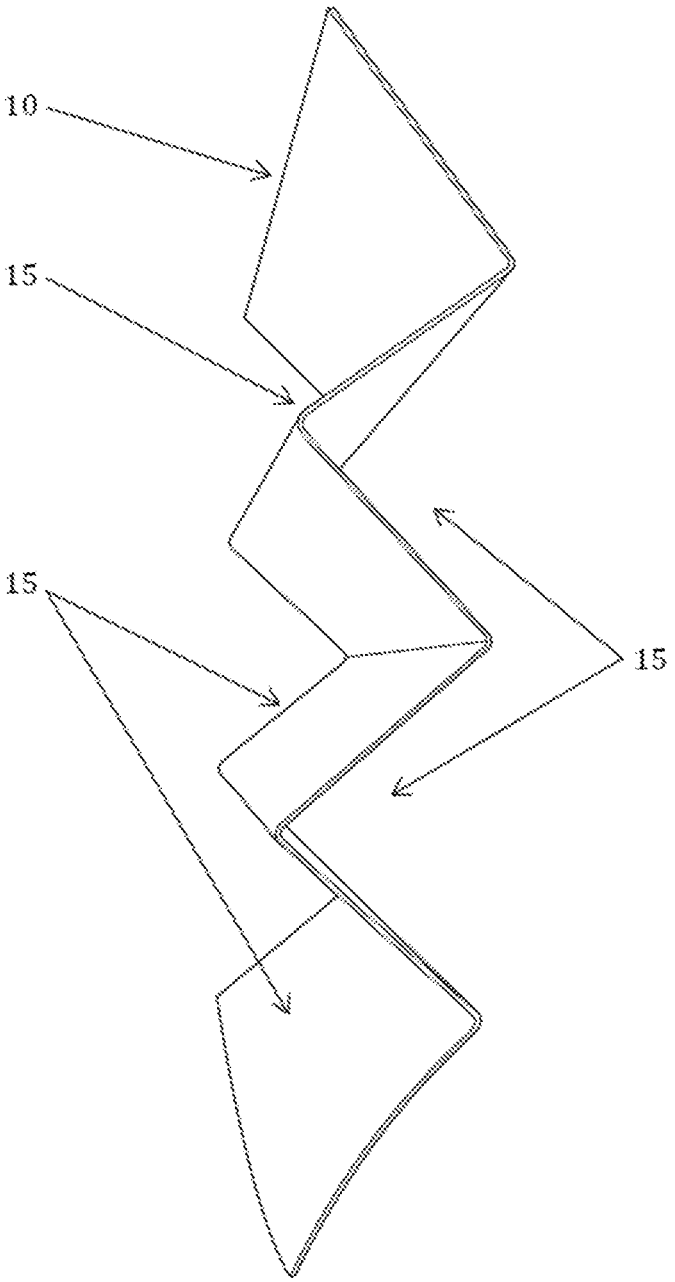
FIG. 4 is a side view of the die cut, scored, coated board divider of FIG. 1.

Turning to FIG. 4, it should be apparent that the die-cut board 10 has three-divider chambers 15 in one side and two-divider chambers 15 in the opposite side. Thus, if the two-divider chambers 15 are topside, in a box, one can flip the die-cut board upside down and the three-divider chambers 15 then are positioned topside instead and vice versa.

While the foregoing description and drawings represent the preferred embodiments of the present invention, it will be understood that various changes and modifications may be made without departing from the scope of the present invention.

What is claimed is:

1. A divider, comprising:

a die-cut board configured to move under manual force between a fully flattened condition and a completely folded condition and being movable from the fully folded condition to a released condition that is intermediate the fully flattened condition and fully folded condition upon release of the manual force, wherein the die-cut board has a plurality of scored lines spaced apart from each other and bending at each of the scored lines to form a series of alternating peak and valley folds between panels of the die-cut board, each of the scored lines having a depth sufficient for spring-back memory so that the release of the die-cut board from the completely folded condition results in the die-cut board unfolding to spread out into the released condition;

a plurality of divider chambers each defined by a respective pair of the panels that has a respective one of the valley folds between the pair of the panels, the plurality of divider chambers being configured so that in the released condition the respective pair of the panels incline from the respective one of the valley folds;

sides that taper from associated ones of the peak folds to neighboring ones of the valley folds so as to define a peripheral region at a level where the peak folds reside that is wider than a peripheral region defined at another level where the valley folds reside; and a water based, grease-resistant coating that coats faces of the panels.

2. The divider of claim 1, wherein the water based, grease-resistant coating coats an entirety of all faces of the panels.

3. A divider, comprising:

a die-cut board configured to move under manual force between a fully flattened condition and a completely folded condition and being movable from the fully folded condition to a released condition that is intermediate the fully flattened condition and fully folded condition upon release of the manual force, wherein the die-cut board has a plurality of scored lines spaced apart from each other and bending at each of the scored lines to form a series of alternating peak and valley folds between panels of the die-cut board, each of the scored lines having a depth sufficient for spring-back memory so that the release of the die-cut board from the completely folded condition results in the die-cut board unfolding to spread out into the released condition;

a plurality of divider chambers each defined by a respective pair of the panels that has a respective one of the valley folds between the pair of the panels, the plurality of divider chambers being configured so that in the released condition the respective pair of the panels incline from the respective one of the valley folds; and a water based, grease-resistant coating that coats faces of the panels, wherein the die-cut board has at least one line of perforations that passes through the series of alternating peak and valley folds.

4. The divider of claim 3, wherein the die-cut board has sides that taper from associated ones of the peak folds to neighboring ones of the valley folds so as to define a peripheral region at a level where the peak folds reside that is wider than a peripheral region defined at another level where the valley folds reside.

5. The divider of claim 4, wherein the at least one line of perforations includes two sidelines of perforations that are substantially parallel to each other with the die-cut board in a flattened condition.

6. The divider of claim 5, wherein the at least one line of perforations further includes an additional line of perforations that is substantially parallel to the two sidelines of perforations with the die-cut board in the fully flattened condition, the additional line of perforations being arranged spatially apart from and between the two sidelines of perforations.

7. The divider of claim 3, wherein the depth of the scored lines is at most 40 percent of a total thickness of the die-cut board.

8. In combination, the divider of claim 4 and a box whose sidewalls taper from a top of the box to a bottom of the box, the box containing the die-cut board positioned so that a tapering of sides of the divider is accommodated against the taper of the sidewalls of the box with an underside of the die-cut board resting on a topside of a bottom of the box.

9. The combination of claim 8, wherein the die-cut board has opposite edges that press against opposite walls of the box.

10. A divider, comprising:

two die-cut board halves each configured to move under manual force between a fully flattened condition and a completely folded condition and being movable from the fully folded condition to a released condition that is intermediate the fully flattened condition and fully folded condition upon release of the manual force, the two die-cut halves having corresponding severed portions of perforations along respective edges that complement each other, wherein each of the die-cut board halves has:

a plurality of scored lines spaced apart from each other and bending at each of the scored lines to form a series of alternating peak and valley folds between panels of an associated one of the two die-cut board halves, each of the scored lines having a depth sufficient for spring-back memory so that the release of the associated one of the two die-cut board halves from the completely folded condition results in the associated one of the two die-cut board halves unfolding to spread out into the released condition;

a plurality of divider chambers each defined by a respective pair of the panels that has a respective one of the valley folds between the pair of the panels, the plurality of divider chambers being configured so that in the released condition, the respective pair of the panels incline from the respective one of the valley folds; and a water based, grease-resistant coating that coats faces of the panels.

11. In combination, the divider of claim 10 and two boxes, the two die-cut board halves each having opposite edges pressed against opposite walls of respective ones of the two boxes.

12. The combination of claim 11, wherein one of the two die-cut board halves is in a flipped over orientation relative to that of a remaining one of the two die-cut board halves so that each presents a different number of divider chambers facing topside.

13. The divider of claim 10, wherein the water based, grease-resistant coating coats an entirety of all faces of the panels of each of the die-cut board halves.

14. The divider of claim 10, wherein the die-cut board halves each have sides that taper from associated ones of the peak folds to neighboring ones of the valley folds so as to define a peripheral region at a level where the peak folds reside that is wider than a peripheral region defined at another level where the valley folds reside.

15. The divider of claim 11, wherein the die-cut halves each have a respective sideline of perforations that is substantially parallel to an associated edge along which are the corresponding severed portions of perforations.

16. The divider of claim 10, wherein the depth of the scored lines is at most 40 percent of a total thickness of the die-cut board.

* * * * *